US005499811A

United States Patent [19]

Hayashi et al.

[11] Patent Number: 5,499,811

[45] Date of Patent: Mar. 19, 1996

[54] SHEET POST-PROCESSING APPARATUS

[75] Inventors: Kenichi Hayashi, Tokyo; Kimiaki Hayakawa; Yoshifumi Takehara, both of Yokohama, all of Japan

[73] Assignee: Canon Kabushiki Kaisha, Tokyo, Japan

[21] Appl. No.: 311,897

[22] Filed: Sep. 26, 1994

Related U.S. Application Data

[63] Continuation of Ser. No. 977,660, Nov. 17, 1992, abandoned.

[30] Foreign Application Priority Data

Nov. 18, 1991 [JP] Japan ..... 3-301874

[51] Int. Cl.[6] ..... B65H 39/10

[52] U.S. Cl. ..... 271/293; 271/294; 271/221; 271/224

[58] Field of Search ..... 271/220, 221, 271/224, 292, 293, 294; 355/322

[56] References Cited

U.S. PATENT DOCUMENTS

| | | | |
|---|---|---|---|
| 5,011,130 | 4/1991 | Naito et al. | 271/288 |
| 5,021,837 | 6/1991 | Uto et al. | 355/322 |
| 5,035,412 | 7/1991 | Hiroi et al. | 270/53 |
| 5,050,860 | 9/1991 | Matsuo et al. | 271/293 |
| 5,090,673 | 2/1992 | Kitahara et al. | 271/221 X |

FOREIGN PATENT DOCUMENTS

| | | | |
|---|---|---|---|
| 0355751 | 2/1990 | European Pat. Off. | 271/293 |
| 57-174184 | 10/1982 | Japan . | |
| 58-2155 | 1/1983 | Japan . | |
| 0223658 | 12/1984 | Japan | 271/293 |
| 0102364 | 6/1985 | Japan | 271/293 |
| 0046863 | 2/1987 | Japan | 271/270 |
| 0231767 | 9/1989 | Japan | 271/292 |
| 0074697 | 3/1992 | Japan | 271/292 |
| 2173483 | 10/1986 | United Kingdom | 271/293 |

*Primary Examiner*—William E. Terrell
*Assistant Examiner*—Carol L. Druzbick
*Attorney, Agent, or Firm*—Fitzpatrick, Cella, Harper & Scinto

[57] ABSTRACT

A sheet post-processing apparatus includes bin trays for stacking sheets; sheet discharger for discharging sheets to the bin trays; an aligner for aligning the sheets received by the bin trays by urging them; a controller for controlling the aligner; wherein the controller moves the aligner to a first position for a first alignment and to a second position for a second alignment to provide offset between succeeding sets of sheets received by the bin trays.

38 Claims, 10 Drawing Sheets

SHEET POST-PROCESSING APPARATUS

This application is a continuation of application Ser. No. 07/977,660, filed Nov. 17, 1992, now abandoned.

FIELD OF THE INVENTION AND RELATED ART

The present invention relates to a sheet post-processing apparatus such as a sorter for sorting and accommodating sequentially onto bin trays sheet materials discharged after image formation thereon from an image forming apparatus such as copying machine, printer or laser beam printer.

Heretofore, in a sheet post-processing apparatus (sorter) installed on the sheet discharging side of an image forming apparatus, the number of bin trays is limited, and it is not possible to sort and accommodate a number of sets of sheets exceeding the number of the bin trays. The same applies to a sheet post-processing apparatus (finisher) having only one tray. In an attempt to solve this problem, the following proposals have been made:

1. The sheets once accommodated on a bin tray are stacked through a conveying means on a stack tray which is another tray other than the bin tray, thus emptying the bin tray, thus permitting the additional sheets to be sorted and accommodated. By repeating the conveyance from the bin tray to the stack tray, a larger number of sets of the sheets than the bin number are stacked.

2. In a combination of a finisher having one tray which is movable in a vertical direction and in a direction perpendicular to the sheet movement direction and an automatic document feeder capable of automatically circulating the originals, the tray position is shifted for one circulation of the originals (one set). Then, the sets are shifted from each other to sort and accommodate a plural number of sets of originals on one tray.

3. A plurality of sorters are connected to increase the number of trays to permit a large number of sets to be sorted and accommodated.

However, in a structure corresponding to proposal 1, a stack is needed in addition to the bin tray with the result of a bulky apparatus. Particularly where the size of the main assembly of the image forming apparatus is small, this option is not suitable. The size increase of the apparatus results in the cost increase.

In a structure corresponding to proposal 2, the entirety of the mechanism supporting the bin trays has to move resulting in a complicated structure. For each set of originals copied, the originals have to be circulated. If the number of sets of copies required is large, the originals are likely to be damaged.

In a structure corresponding to proposal 3, two or three sorters have to be connected in series, thus requiring a large space with the result of high cost.

SUMMARY OF THE INVENTION

Accordingly, it is a principal object of the present invention to provide a sheet post-processing apparatus such as a sorter which is capable of sorting and accommodating a larger number of sets of originals than the number of the bin trays.

According to an aspect of the present invention, there is provided a sheet post-processing apparatus comprising: a tray for stacking sheets; sheet discharging means for discharging sheets to said tray; aligning means for aligning the sheets received by said tray by urging them: control means for controlling said aligning means: wherein said control means moves said aligning means to a first position for first alignment and to a second position for second alignment to provide an offset between sets of sheets received by respective bins.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of the present invention will be described in conjunction with the accompanying drawings.

Figure 1:
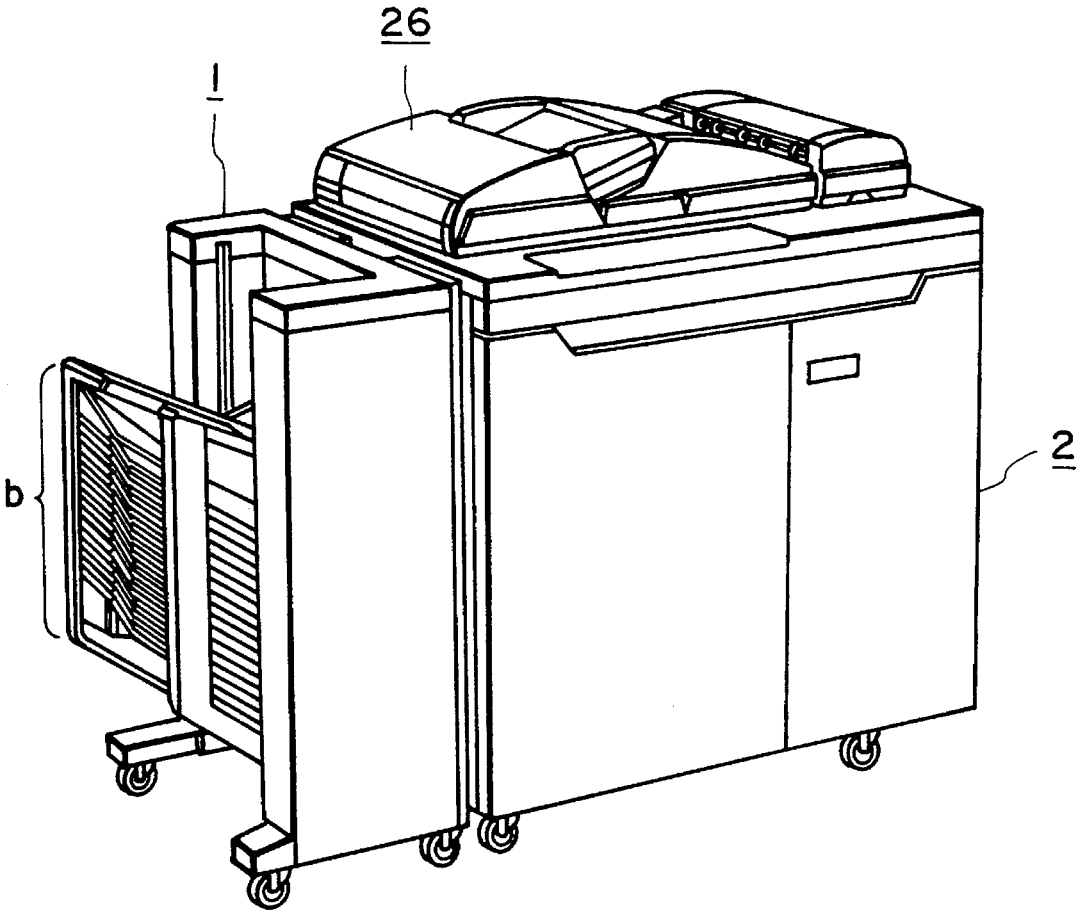
FIG. 1 shows a general arrangement of the apparatus according to an embodiment of the present invention.

FIG. 1 shows a sheet post-processing apparatus according to an embodiment of the present invention. As shown in FIG. 1, an automatic document feeder 26 is provided at the top of the image forming apparatus to automatically circulate the originals. In addition, at a downstream side, there is provided a sorter 1 having one or more bin trays b.

Figure 2:
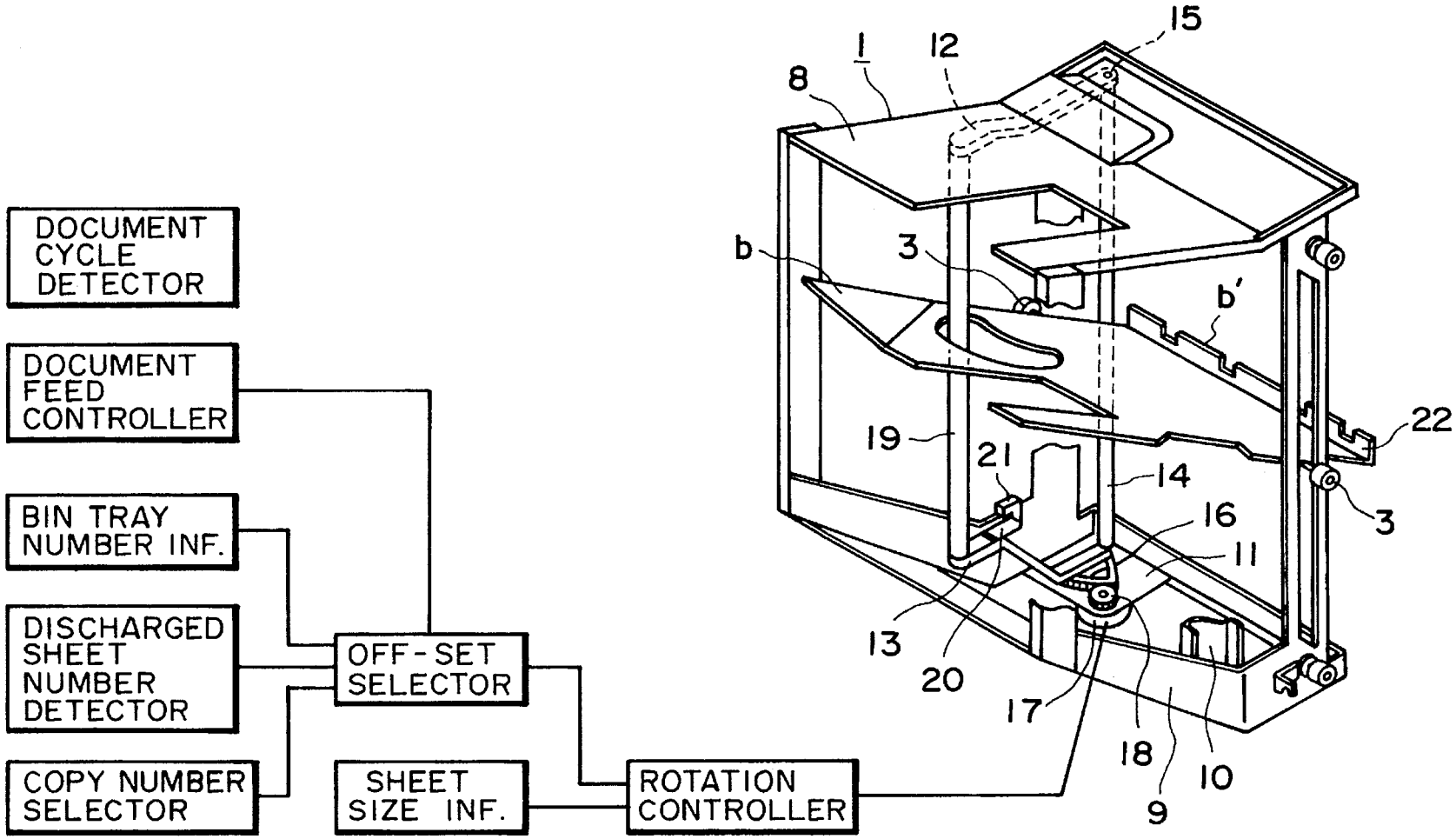
FIG. 2 is a perspective view of a sorter.
Figure 3:
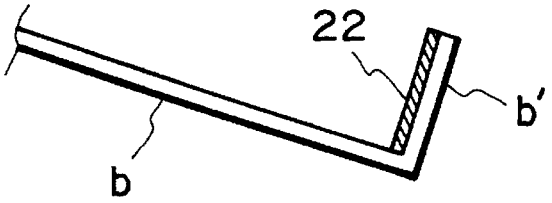
FIG. 3 shows a part of a bin tray.
Figure 6:
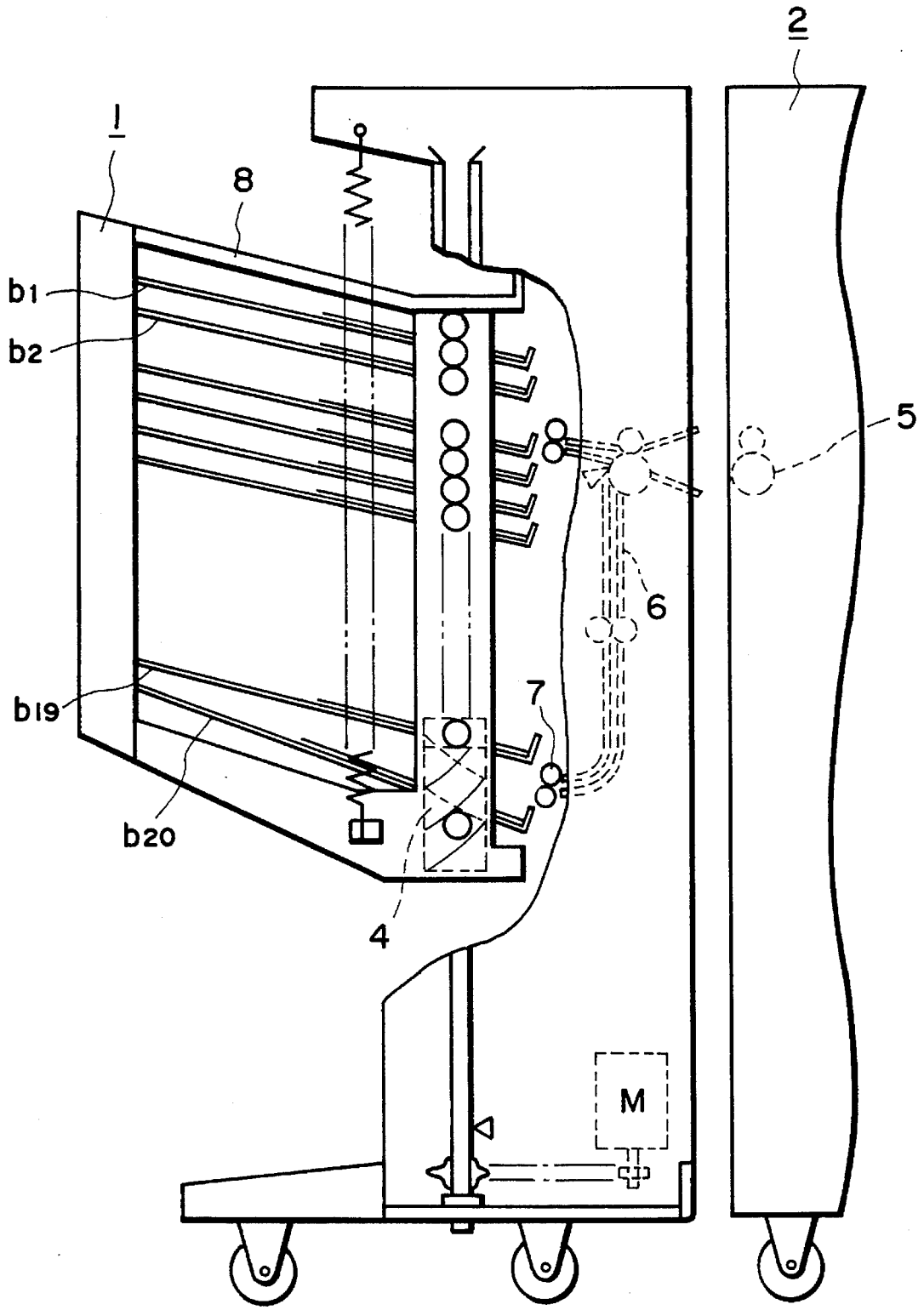
FIG. 6 shows a state in which a second sheet is being discharged.

FIGS. 2, 3 and 6 show details of the sorter 1. The sorter 1 has bin trays b stacked in the vertical direction. Each of the bin trays b is provided with rollers (trunnions) 3 at both sides thereof, which are engaged in helical grooves of a screw 4 and are moved up and down by one rotation of the screw 4.

The sheet discharged from an image forming apparatus 2 is discharged by discharging rollers 7 at a lower portion of the sorter 1 through discharging rollers 5 of the Image forming apparatus 2 and through a discharge path defined by two guide plates 6.

Since the structures and operations of screws 4 and automatic document feeder 26 are known, the detailed descriptions thereof are omitted for simplicity.

The sorter 1 is provided with aligning means for aligning the sheets discharged onto the bin trays b. This will be described in detail, referring to FIG. 2.

An alignment reference member 10 extends from a bin cover 8 to the bottom of bin frame 9. To the base and rear side of the bin frame 9, supporting plates 11 are fixed. A rotational shaft 14 is fixed to an upper arm 12 at its upper end and to a lower arm 13 at its lower end. On the supporting plate 11, the rotational shaft 14 is rotatably supported on a rotatable shaft (not shown) on the supporting plates 11 and is also rotatably supported on a rotatable shaft 15 on bin cover 8. On the supporting plates 11, a sector gear 16 is mounted for rotation about a shaft mounted on the supporting plates 11. The lower arm 13 is fixed on the sector gear 16. Below the supporting plates 11, a pulse motor 17 is disposed. To an output shaft of the motor 17, a gear 18 is fixed, and the sector gear 16 is in meshing engagement with the gear 18. Between an end of the lower arm 13 and an end of upper arm 12, an aligning rod 19 is connected through openings of the bin trays. The aligning rod 19 swings with the top and bottom arms 12 and 13 by the rotation of sector gear 16. The lower arm 13 is provided with a light blocking plate 20 so that by rotation of the light blocking plate 20 with the bottom arm 13, a home position sensor 21 disposed at a rear side of the bin frame 9, is actuated and deactuated.

A rear stopper b' for abutment with the rear end of the sheet upon sheet accommodation is mounted to the rear of the bin tray b (sheet receiving sight). A rubber member 22, for example, having a predetermined friction coefficient is fixedly mounted to the sheet abutment surface of the rear stopper b' (FIG. 3). The predetermined friction coefficient is such that the friction coefficient between the trailing edge of the sheet and the rubber member 22 is larger than that between the sheets and that the sheet movement is not obstructed after contact with the trailing edge of the sheet.

When the number of sets of copies is larger than the number of the bin trays, for example, when the number of the bin trays of the sorter is 20 and the number of sets of copies is 30, the operation is as follows.

Figure 4:
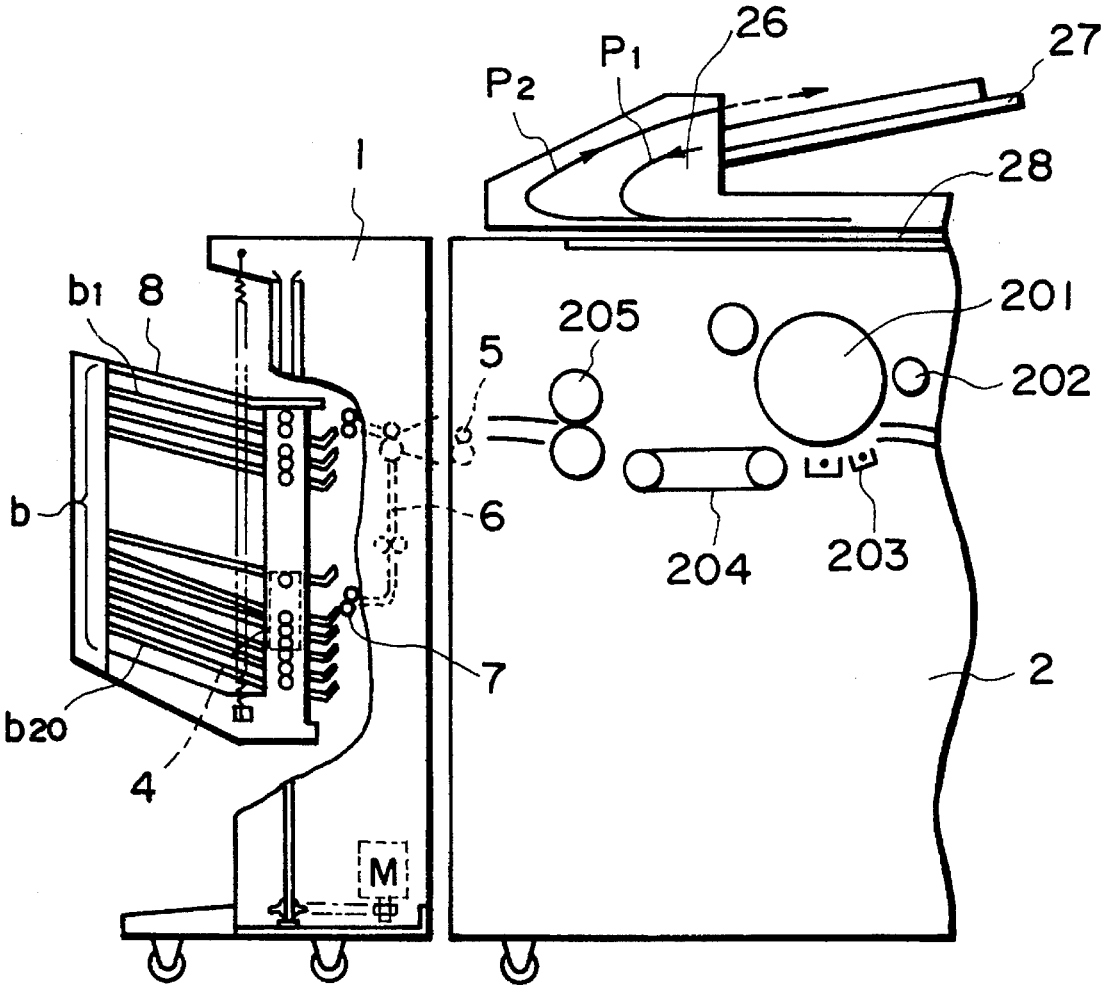
FIG. 4 shows in detail a sorting apparatus.
Figure 5:
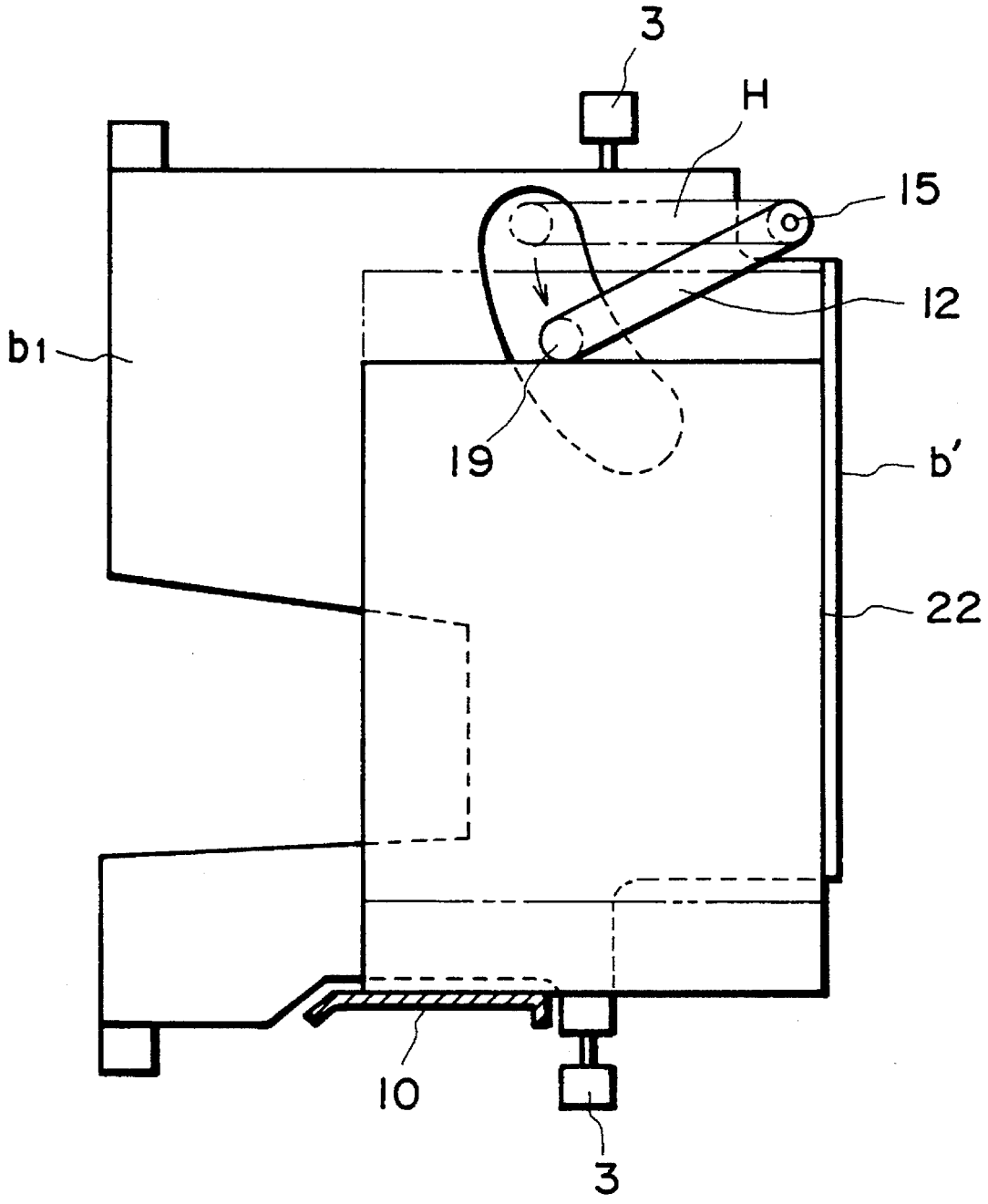
FIG. 5 illustrates alignment of sheets on a bin tray.

As shown in FIG. 4, in an automatic document feeder 26, the set of the originals is placed on the original tray 27 with the image facing up. The originals are separated from the bottom, so that the originals are fed out, from the bottom page, onto a platen glass 28 through a path P1. An image forming device 2 including the platen glass 28 also includes a photosensitive drum 201, a developing device 202, a transfer electrode 203, a conveyer belt 204, an image fixing device 205 and the like. After the original is stopped on the platen glass 28, an unshown optical system is operated to start the image forming operation. After the image transfer and fixing, the sheet is discharged to a first bin tray b1 (lowered to a position facing the roller 7) through a sheet discharging roller pair 5 of the image forming apparatus 2, a guiding plate 6 of the sorter and discharging roller pair 7 (FIG. 6). The sheet discharged to the bin tray b1 moves to the rear stopper b' by the weight thereof on the bin tray and stops there, since the bin tray is inclined downwardly toward the rear stopper b' (chain line).

By a pulse motor 17 rotatable in response to pulse signals corresponding to the size of the sheet discharged, an aligning rod 19 placed at the home position H starts to move in the direction A through a predetermined distance. After it abuts the lateral end of the sheet, it further moves until the other lateral edge of the sheet abuts an alignment reference member 10. Thereafter, the aligning rod 19 returns to the home position H, thus preparing for the next sheet discharge.

Thus, one sheet is stacked on the bin tray. Then the rotatable member 4 rotates to raise the bin trays to face the next bin tray to the discharging roller pair 7. The sheet discharging operation to the next bin tray and the subsequent bin tray is the same as described above. Finally, all of the bin trays receive the copies of the final page of the original, and the lateral edges thereof are contacted to the alignment reference member 10, and the trailing edges thereof are aligned by abutment to the rear end stopper b'.

Upon completion of 20 copies for the one original, the final original on the platen 28 is discharged to the topmost of the stack of the originals on the original tray 27 along the path P2. It should be noted that between the copied originals and the uncopied originals, a dividing lever is disposed (not shown) to provide separation therebetween.

Then, the current bottommost original (the second from the last page) is fed to the predetermined position of the platen glass 28, and the sheet having been subjected to the image transfer and image fixing by the image forming device 2 is first discharged to the 20th bin tray b20 placed to the position of the discharging roller pair 7 (FIG. 6). The aligning operation is the same as described in the foregoing. By rotation of the rotatable member 4, the bin tray b is sequentially lowered, so that the second sheets are aligned on the bin trays.

The foregoing operations are repeated for the number of the sets of the copies to be taken, so that the 20 copies are aligned and stacked on the bin trays. At this time, all of the originals have been processed by the automatic document feeder 26 (one circulation), so that the first page is at the top, and the discharging roller pair 7 of the sorter 1 is at the same position as the first bin tray b1 (the number of originals is even).

Figure 7:
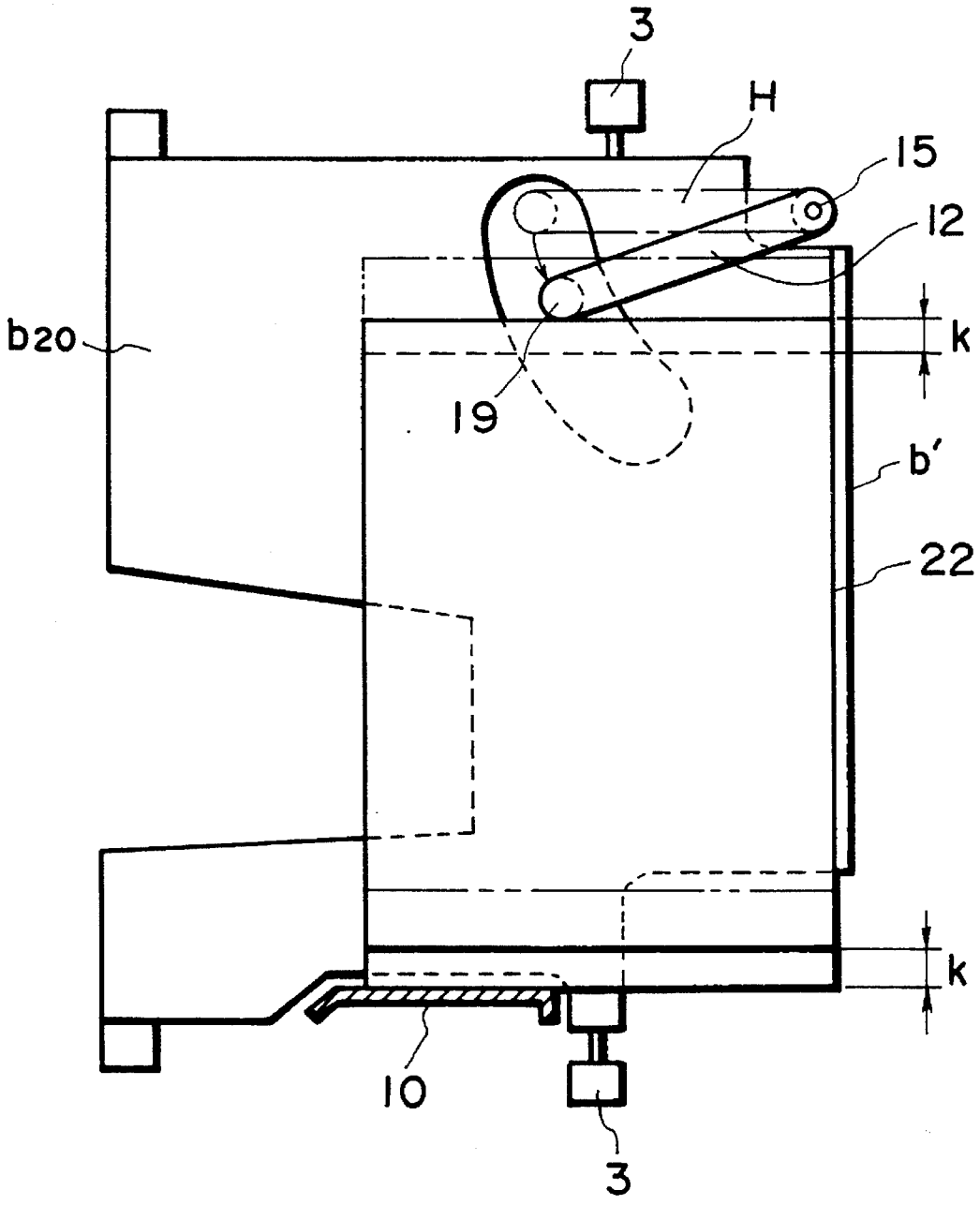
FIG. 7 shows a state in which a twenty-first sheet is being discharged.

The description will be made as to the stacking operation for 21–30 sets. Similarly to the foregoing, the last page of the originals on the original tray 27, is fed to the predetermined position on the platen glass 28. The sheet having been subjected to the image transfer and image fixing operations of the image forming apparatus 2, is discharged to the top of the first set of the sheets on the first bin tray b1. In case, the alignment rod 16 swings by the rotating pulse motor 17. However, the movement distance is decreased by k from the movement distance of the first 20 sets. More particularly, the movement distance of the aligning rod 19 for the first 20 sets, is suitable to abut the lateral edge of the sheet to the reference member 10, but for 21–30th sets, the aligning rod is moved through such a distance as to provide an offset k between the lateral edge of the sheet and the reference member 10 (FIG. 7). Therefore, the set consisting of the first 20 sheets is discriminated from 21st and subsequent sets.

After completion of the sheet discharge and alignment to the bin tray b1, the bin tray is raised by the rotation of the rotatable member 4, until the sheets are stacked and aligned on 1–10th bin tray b10. Then, on the bin trays b1–b10, one sheet is stacked in an offset manner on the sets of sheets already stacked. Then, the original is exchanged by the automatic document feeder 26, and the new original (2 pages from the last) is copied. The sheet having been subjected to the transfer and fixing operation, is first discharged to the bin tray b10. The aligning rod 19 moves through the same amount as before. Since the end stopper b' is provided with a rubber member 22 having a far higher friction coefficient than that between the sheets, the sheets below it are not influenced and they remain stationary even if the newly discharged sheet moves by the swinging motion of the aligning rod. Subsequently, the bin tray is raised by the rotation of the rotatable member 4 until the bin b1 is aligned to receive the sheet. The operation is repeated for the number of originals. Then, 30 sets of sheets are sorted and accommodated on the sorter having only 20 bin trays.

Figure 8:
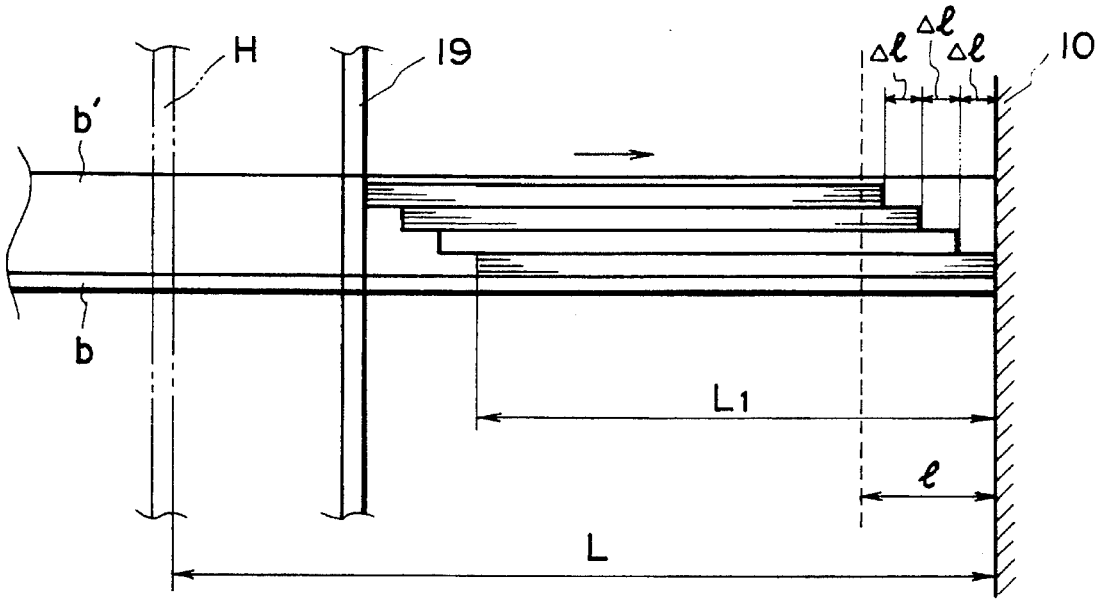
FIG. 8 illustrates the sorted states.

As shown in FIG. 8, one bin tray b can accommodate n sets of sheet materials with spatial separations therebetween ($1 \geqq n \times \Delta 1$) where $L_1$ is a size of the copy sheet, 1 is the discharge position before the sheet alignment (the distance between the lateral edge of the sheet and the alignment reference member 10), Δ1 is an offset mount of the sheet sets.

Figure 9:
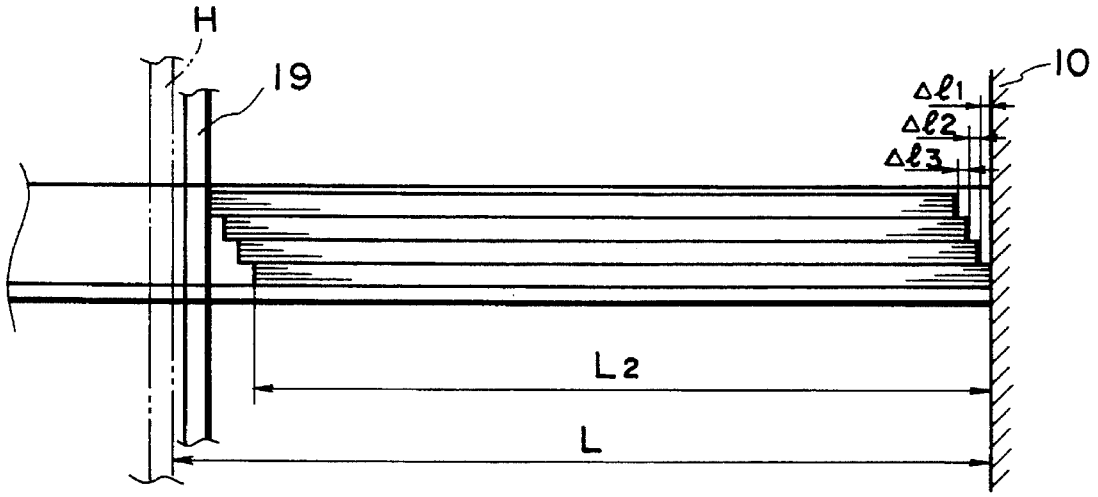
FIG. 9 illustrates another example of the sorted states.

When the copy sheet size is larger than $L_1$, that is, $L_2$, the distance L between the alignment reference member 10 and the alignment rod home position H is limited. Therefore, if the same offset amount Δ1 is used, it may be possible that n sets are not properly accommodated. Therefore, in such a case, the offset distance is made smaller than Δ1, by which the sortable number of the sets can be increased (FIG. 9).

Figure 10:
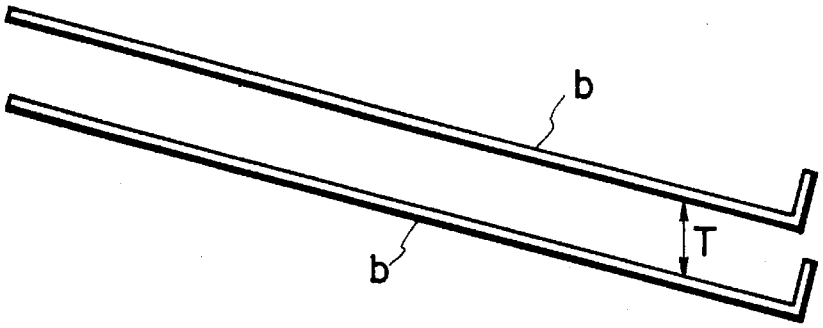
FIG. 10 illustrates a gap between adjacent trays.

Since the vertical interval between adjacent trays b is T (FIG. 10), with an increase in the number of sheets, the image forming apparatus 2 produces a warning signal if the thickness of the set of the sheets to be accommodated exceeds T.

Another Embodiment

In the foregoing embodiment, in order to prevent deviation of the sheets stacked on the bin trays, the end stopper is provided with a high friction coefficient member attached thereto. In the present embodiment, another deviation preventing means is used.

Figure 11:
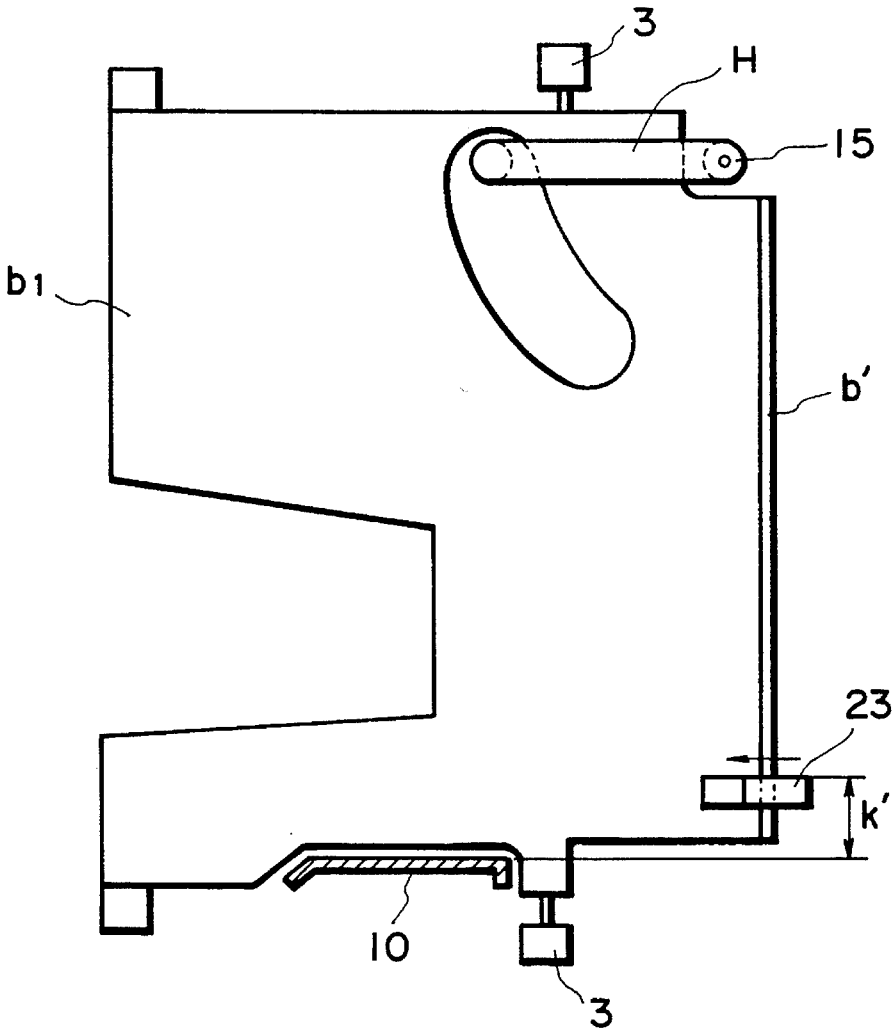
FIG. 11 is a top plan view of a bin tray according to another example of the present invention.
Figure 12:
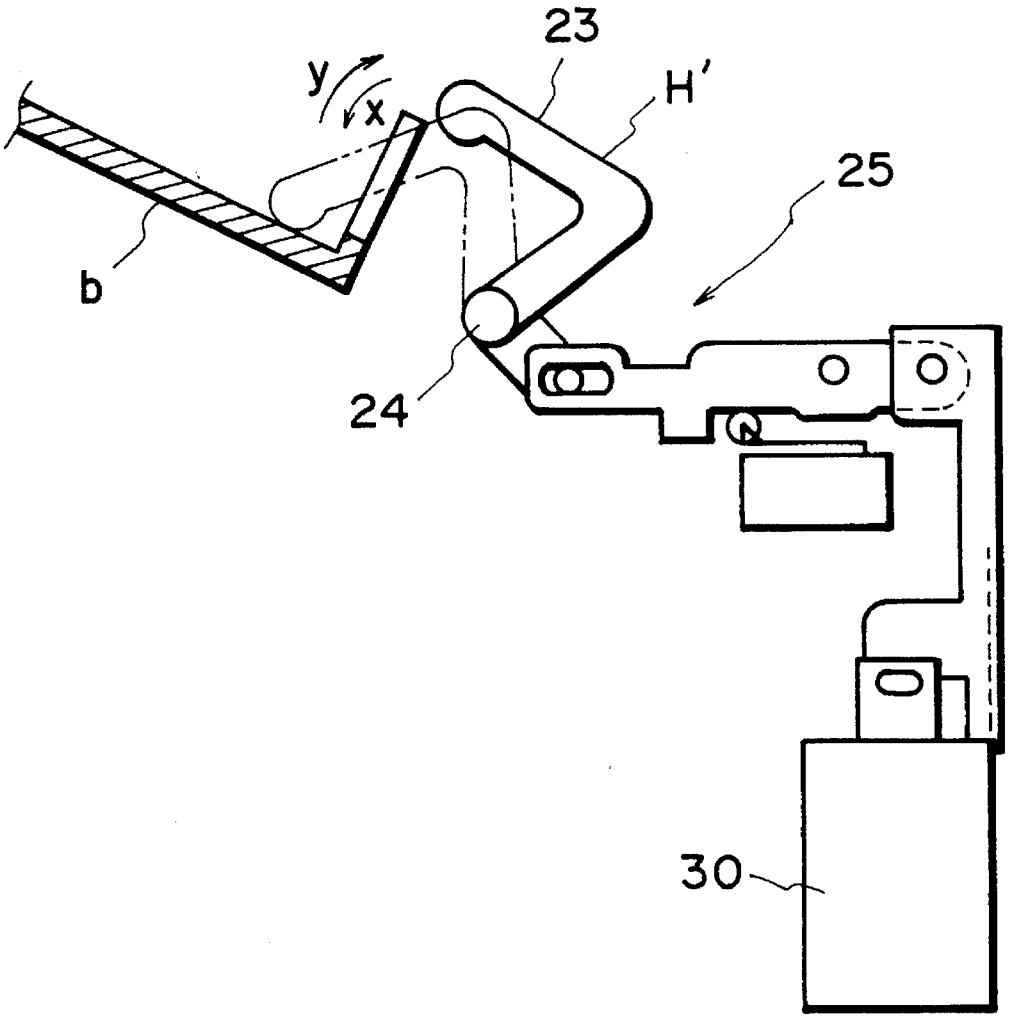
FIG. 12 shows detail of element 23 in FIG. 11.

As shown in FIGS. 11 and 12, a confining device 25 is fixedly mounted on the sorter at a position K' away from the reference member 10 of the sheet discharging bin (the bin tray receiving the sheet discharged). The confining device 25 is provided with an arm 23 which swings in x direction about a pin 24 in response to actuation of a solenoid 30. The other structures of the apparatus of this embodiment are the same as in the foregoing embodiment. In order to change the sheet receiving bin, the rotatable member 4 is rotated to shift the bins one-by-one. At this time, the arm 23 of the confining device 25 moves in Y direction by deenergization of the solenoid away to a rest position to avoid interference with the bin shifting operation.

The operation will be described in the case that the number of bin trays in the sorter is 20 and that the number of sets to be copied is 30. The stacking operation for the first 20 sets, is the same as in the foregoing embodiment. The originals are circulated by the automatic document feeder and the copy sheets are aligned and received on the bin trays.

Figure 13:
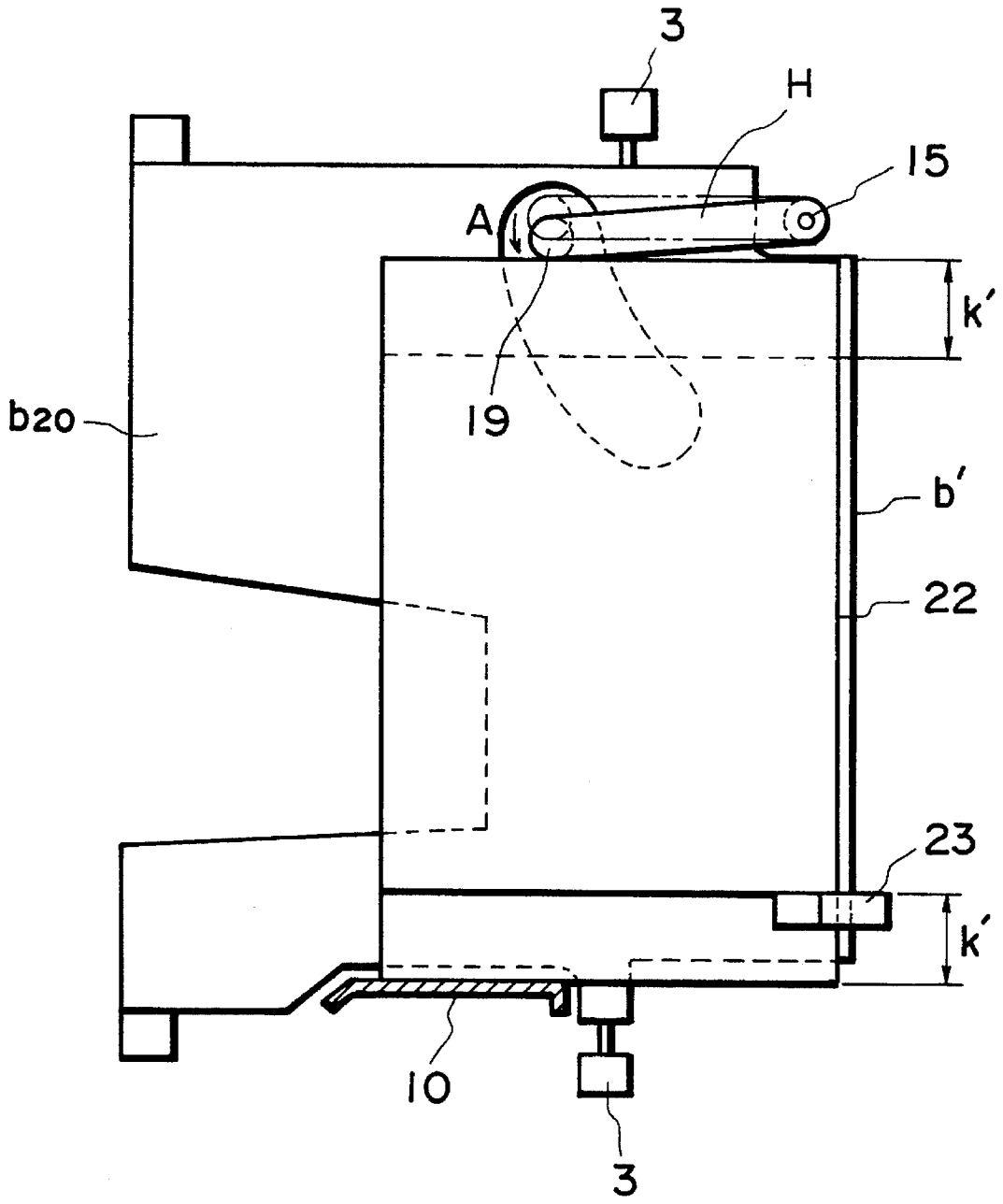
FIG. 13 shows the operation of FIG. 11 apparatus.

In the second circulation of the originals, the copy sheets in this cycle are discharged to the bin trays b1–b10. However, before the discharge of the sheet, the solenoid 30 is energized so that the arm 23 is actuated at a predetermined position K' away from the reference member 10. After this, the copy sheet in the second circulation is stacked on each of the sets of copy sheets on the bin trays b1–b10. By a pulse motor 17 responsive to predetermined pulse signals, the aligning rod 19 starts to move in the direction A through a predetermined distance (FIG. 13). During this movement, it abuts the lateral edge of the sheet, and continues to move until the other lateral edge contacts to the arm 23 (FIG. 13). The aligning rod 19 and the arm 23 are moved to the respective retracted positions H and H' for each bin shifting action so as to avoid interference with the sheet discharge and the bin shifting actions.

The above operation is repeated for the number of originals. Then, 1–20th sets of originals and 21–30th sets of originals are stacked with the offset K' therebetween. As a result, 30 sets of sheets are sorted and received on the sorter having only 20 bin trays. Since K' is predetermined, the movement distance of the aligning rod is changed, accordingly. Thus, the offset sheets are aligned, too, at the lateral edges.

Where the confining device urges only at one predetermined position as in this embodiment, one bin can sortedly receive two sets of sheets at the maximum, and therefore, if the sorter has 20 bin trays, it can sort and receive 40 sets in total at the maximum. If, however, the sheet confining device is movable in a direction perpendicular to the conveying direction to permit arm urging at plural positions, the number of reference positions at which the lateral edges of the sheets abut, can be increased. As a result, more than two sets can be sorted and received by one bin (more than 40 sets in total).

Generally, a sorter (staple sorter) capable of stapling the sets of sheets stacked on the bin trays is provided with a sheet confining member for confining the sheets being stapled on the bin tray. In such a case, the confining member may be used for the arm 23 of this embodiment.

In the foregoing embodiments, the aligning operation by the aligning rod is carried out after each sheet is discharged onto a bin tray, but it is a possible alternative that the aligning rod be moved after a predetermined number of bin trays receive the respective sheets. In this case, plural sheets are aligned simultaneously.

While the invention has been described with reference to the structures disclosed herein, it is not confined to the details set forth and this application is intended to cover such modifications or changes as may come within the purposes of the improvements or the scope of the following claims.

What is claimed is:

1. A sorter comprising:

bin trays, for sequentially receiving sheets;

aligning means for aligning sheets on said bin trays; and control means for controlling said aligning means to provide offset between sets of sheets previously received by said bin trays and sets of sheets of an equal size to each other currently being received by said bin trays, for each bin tray that receives a set of sheets currently being received after receiving a set of sheets previously received.

2. A sorter according to claim 1, further comprising reference means, wherein said aligning means aligns the sheets on said bin trays by urging the sheets to said reference means, and the offset is provided by changing the amount the sheets are shifted by said aligning means.

3. A sorter according to claim 2, wherein an aligning operation is performed by said aligning means for each sheet received on a respective bin tray.

4. A sorter according to claim 2, wherein said aligning means is operated after a predetermined number of bin trays receive respective sheets, so that plural sheets are aligned simultaneously.

5. A sorter comprising:

a number of bin trays, wherein respective bin trays accommodate plural sheets one by one;

aligning means for aligning sheets on said number of bin trays; and control means for controlling said aligning means to provide offset between sets of sheets received by each of said number of bin trays after a number of sets of sheets received exceeds the number of bin trays.

6. A sorter according to claim 5, further comprising reference means, wherein said aligning means aligns the sheets on said bin trays by urging the sheets to said reference means, and the offset is provided by changing the amount the sheets are shifted by said aligning means.

7. A sorter according to claim 6, wherein an aligning operation is performed by said aligning means for each sheet received on a respective bin tray.

8. An apparatus according to claim 6, wherein said aligning means is operated after a predetermined number of bin trays receive respective sheets, so that plural sheets are aligned simultaneously.

9. An image forming apparatus comprising:

image forming means for forming an image on a sheet;

bin trays for stacking sheets thereon;

sheet discharging means for discharging sheets on which images have been formed to said bin trays;

aligning means for aligning sheets on said bin trays; and control means for controlling said aligning means to provide offset between sets of sheets previously received by said bin trays and sets of sheets of an equal size to each other currently being received by said bin trays, for each bin tray that receives a current set of sheets after receiving a previous set of sheets.

10. An apparatus according to claim 9, further comprising reference means, wherein said aligning means aligns the sheets on said bin trays by urging the sheets to said reference means, and the offset is provided by changing the amount the sheets are shifted by said aligning means.

11. An apparatus according to claim 10, wherein an aligning operation is performed by said aligning means for each sheet received on a respective bin tray.

12. An apparatus according to claim 10, wherein said aligning means is operated after a predetermined number of bin trays receive respective sheets, so that plural sheets are aligned simultaneously.

13. An image forming apparatus comprising:

image forming means for forming an image on a sheet;

a number of bin trays for stacking sheets thereon;

sheet discharging means for discharging sheets on which images have been formed to said bin trays;

aligning means for aligning sheets on said bin trays; and control means for controlling said aligning means to provide offset between sets of sheets received by each of said bin trays when a number of sets of sheets exceeds the number of bin trays, for each bin tray that receives a current set of sheets after receiving a previous set of sheets.

14. An apparatus according to claim 13, further comprising reference means, wherein said aligning means aligns the sheets on said bin trays by urging the sheets to said reference means, and the offset is provided by changing the amount the sheets are shifted by said aligning means.

15. An apparatus according to claim 14, wherein an aligning operation is performed by said aligning means for each sheet received on a respective bin tray.

16. An apparatus according to claim 14, wherein said aligning means is operated after a predetermined number of bin trays receive respective sheets, so that plural sheets are aligned simultaneously.

17. An image forming apparatus, comprising:

an automatic document feeder for automatically feeding plural original documents;

image forming means for producing plural copy sheets of each of the original documents;

a number of bin trays for stacking copy sheets thereon;

aligning means for aligning copy sheets on said bin trays; and control means for controlling said aligning means to provide offset for sets of sheets on each of said bin trays when a number of sets of sheets exceeds the number of bin trays, wherein each set of sheets includes sheets of equal size to each other set of sheets.

18. An apparatus according to claim 17, further comprising reference means, wherein said aligning means aligns the sheets on said bin trays by urging the sheets to said reference means, and the offset is provided by changing the amount the sheets are shifted by said aligning means.

19. An apparatus according to claim 18, wherein an aligning operation is performed by said aligning means for each sheet received on a respective tray.

20. An apparatus according to claim 18, wherein said aligning means is operated after a predetermined number of bin trays receive respective sheets, so that plural sheets are aligned simultaneously.

21. A sheet post-processing apparatus comprising:

a bin tray for stacking sheets thereon;

sheet discharging means for discharging sheets to said bin tray;

shifting means for shifting the sheets received by said bin tray by urging them;

control means for controlling said shifting means;

wherein said control means controls said shifting means so as to decrease the shifting distance of succeeding sets of sheets thereby producing an offset between succeeding sets of sheets received by said bin tray, wherein each set of sheets includes sheets of equal size to each other set of sheets.

22. An apparatus according to claim 21, wherein a movement distance of said shifting means is controlled in accordance with the size of the sheets, so that the degree of offset is changed in accordance with the size of the sheets.

23. An apparatus according to claim 21, further comprising an alignment reference means, wherein said shifting means urges the set of sheets to said alignment reference means.

24. An apparatus according to claim 23, wherein an aligning operation is performed by said aligning means for each sheet received on a respective bin tray.

25. An apparatus according to claim 23, wherein said aligning means is operated after a predetermined number of bin trays receive respective sheets, so that plural sheets are aligned simultaneously.

26. An apparatus according to claim 21, wherein a plurality of such bin trays are provided.

27. An apparatus according to claim 21, wherein said bin tray is provided at a rear end with a stopper having a high friction coefficient member to prevent deviation of the previously stacked sheets by said shifting means.

28. An apparatus according to claim 21, further comprising a retractable sheet confining member for confining the sheets on said bin tray to prevent deviation of the sheets by said shifting means.

29. An image forming apparatus comprising:

image forming means for forming an image on a sheet;

a bin tray for stacking sheets thereon;

sheet discharging means for discharging sheets on which images have been formed to said bin tray;

shifting means for shifting the sheets received by said bin tray by urging them;

control means for controlling said shifting means;

wherein said control means controls said shifting means so as to decrease the shifting distance of succeeding sets of sheets thereby producing an offset between succeeding sets of sheets received by said bin tray, wherein each succeeding set of sheets includes sheets of equal size to each other set of sheets.

30. A sheet post-processing apparatus comprising:

a bin tray for stacking sheets thereon;

sheet discharging means for discharging sheets to said bin tray;

aligning means for aligning sheets received by said bin tray by urging them;

control means for controlling said aligning means; and a reference member, wherein said control means controls said aligning means to urge sheets to a first position for a first alignment wherein edges of the sheets are urged to said reference member and to a second position for a second alignment wherein edges of the sheets are not urged to the reference member thus providing an offset between sets of sheets received by said bin tray.

31. An apparatus according to claim 30, wherein an aligning operation is performed by said aligning means for each sheet received on a respective bin tray.

32. An apparatus according to claim 30, wherein said aligning means is operated after a predetermined number of bin trays receive respective sheets, so that plural sheets are aligned simultaneously.

33. A sorter comprising:

a number of bin trays, wherein respective bin trays accommodate plural sheets one by one;

aligning means for aligning sheets on said bin trays; and control means for controlling said aligning means to provide offset between respective sets of sheets received by said bin trays when a number of sets of sheets exceeds the number of bin trays;

wherein said aligning means aligns sheets on said bin trays by urging the sheets an amount to a reference means, and offset is provided by changing the amount the sheets are shifted by said aligning means.

34. An apparatus according to claim 33, wherein an aligning operation is performed by said aligning means for each sheet received on a respective bin tray.

35. An apparatus according to claim 33, wherein said aligning means is operated after a predetermined number of bin trays receive respective sheets, so that plural sheets are aligned simultaneously.

36. An image forming apparatus comprising:

image forming means for forming an image on a sheet;

a number of bin trays for stacking sheets thereon;

sheet discharging means for discharging sheets on which images have been formed to said bin trays;

aligning means for aligning sheets on said bin trays; and control means for controlling said aligning means to provide offset between sets of sheets received by each of said bin trays when a number of sets of sheets exceeds the number of bin trays, wherein said aligning means aligns the sheets on said bin trays by urging the sheets an amount to a reference means, and offset is provided by changing the amount the sheets are shifted by said aligning means.

37. An apparatus according to claim 36, wherein an aligning operation is performed by said aligning means for each sheet received on a respective bin tray.

38. An apparatus according to claim 36, wherein said aligning means is operated after a predetermined number of bin trays receive respective sheets, so that plural sheets are aligned simultaneously.

* * * * *

UNITED STATES PATENT AND TRADEMARK OFFICE

CERTIFICATE OF CORRECTION

PATENT NO. : 5,499,811 Page 1 of 2

DATED : March 19, 1996

INVENTOR(S) : KENICHI HAYASHI, et al.

It is certified that error appears in the above-indentified patent and that said Letters Patent is hereby corrected as shown below:

Title page item [57] Abstract :

Line 3, "sheet discharger" should read --a sheet discharger--.

COLUMN 1

Line 32, "the" should be deleted.
Line 45, "the" should be deleted.

COLUMN 2

Line 1, "them:" should read --them;--.
Line 2, "means:" should read --means;--.

COLUMN 3

Line 14, "plate 20" should read --plate 20,--.

COLUMN 4

Line 31, "In" should read --In this--.

COLUMN 5

Line 58, "K'" should read --k'--.
Line 60, "K'" should read --k'--.

UNITED STATES PATENT AND TRADEMARK OFFICE

CERTIFICATE OF CORRECTION

PATENT NO. : 5,499,811 Page 2 of 2

DATED : March 19, 1996

INVENTOR(S) : KENICHI HAYASHI, et al.

It is certified that error appears in the above-indentified patent and that said Letters Patent is hereby corrected as shown below:

COLUMN 9

Line 9, "member" should read --member,--.

Signed and Sealed this

Third Day of September, 1996

*Attest:*

*Attesting Officer*

BRUCE LEHMAN

*Commissioner of Patents and Trademarks*